US008122541B1

(12) United States Patent
Georgatos

(10) Patent No.: US 8,122,541 B1
(45) Date of Patent: Feb. 28, 2012

(54) BED SHEET ATTACHMENT SYSTEM

(76) Inventor: Napoleon Georgatos, Levittown, NY (US)

( * ) Notice: Subject to any disclaimer, the term of this patent is extended or adjusted under 35 U.S.C. 154(b) by 186 days.

(21) Appl. No.: 12/799,062

(22) Filed: Apr. 16, 2010

(51) Int. Cl.
*A47G 9/02* (2006.01)

(52) U.S. Cl. ..... 5/498; 5/494; 5/496

(58) Field of Classification Search ..... 5/482, 486, 5/494, 496, 498
See application file for complete search history.

(56) References Cited

U.S. PATENT DOCUMENTS

| | | | | | |
|---|---|---|---|---|---|
| 3,083,378 | A | | 4/1963 | Pursell | 5/334 |
| 3,530,487 | A | * | 9/1970 | Beer | 5/496 |
| 3,832,743 | A | * | 9/1974 | Smith | 5/496 |
| 3,857,124 | A | * | 12/1974 | Hadley | 5/496 |
| 4,389,744 | A | * | 6/1983 | Monroe | 5/498 |
| 4,402,098 | A | * | 9/1983 | McClam | 5/494 |
| 4,546,508 | A | * | 10/1985 | Ison | 5/494 |
| 5,557,814 | A | | 9/1996 | Cybulski | 5/496 |
| 5,884,349 | A | | 3/1999 | Gretsinger | 5/502 |
| 6,044,503 | A | | 4/2000 | McClendon | 5/482 |
| 6,098,219 | A | * | 8/2000 | Milber | 5/494 |
| 6,427,266 | B2 | | 8/2002 | Talley-Williams | 5/482 |
| 6,490,741 | B1 | * | 12/2002 | Wheeler | 5/494 |
| 6,886,197 | B1 | * | 5/2005 | Madigan | 5/482 |
| 7,086,102 | B1 | | 8/2006 | Frazier | 5/502 |
| 7,487,561 | B2 | | 2/2009 | Ho | 5/497 |
| 2008/0040855 | A1 | | 2/2008 | Ho | 5/482 |

* cited by examiner

*Primary Examiner* — Michael Trettel
(74) *Attorney, Agent, or Firm* — Goldstein Law Offices, P.C.

(57) ABSTRACT

A bed sheet attachment system with a pair of expansion panel assemblies that attaches a top cover to a bottom sheet by a plurality of panel strips connected by a plurality of fastener strips. The fastener strips are prevented from opening during sleep by a plurality of snap tabs. The plurality of panel strips provides increased cubic capacity between the top cover and bottom sheet for the sleeper to slip into and move within the bed. The plurality of snap tabs allows the panel strips to be separated at discrete lengths to accommodate the sleeper's needs and desires for the arrangement of the top cover during sleep. The bed sheet attachment system simplifies the daily making of the bed by maintaining the proper position of the top cover during sleep so that the user merely smoothes out the wrinkles on the top cover upon arising.

16 Claims, 7 Drawing Sheets

BED SHEET ATTACHMENT SYSTEM

BACKGROUND OF THE INVENTION

The invention relates generally to a bed sheet attachment system. More particularly, the invention relates to a system for impermanently attaching a top cover to a bottom sheet with a connecting expansion panel assembly and making a bed with the expansion panel assembly in place.

An unmade bed is unsightly and makes a clean room look sloppy and dirty. Children, as part of learning to take responsibility for household chores, are often assigned to make their own beds. Unfortunately, often children find bed-making a struggle and do not allow sufficient time in the morning to complete the task. A popular choice for children's furniture is a bunk bed with one bed set on top of the other. Making the top bunk bed can be especially challenging. Sometimes even adults, caught in the morning rush, do not have the time to properly make the bed. Making the bed requires frequent stooping over, an activity that adults with back problems may find uncomfortable. The bed maker must walk around the bed multiple times, adjusting the top covers to be evenly distributed before tucking in the edges under the mattress.

Changing bed linens and putting on fresh bedding is challenging to children and adults alike, especially if only one person is available. After the bed has been stripped, the user places the fitted bottom sheet on the mattress. Then the user must spread out the top cover over the fitted sheet, making sure that the sides are even, and that there is sufficient material on the bottom to tuck under. Attempting to tuck one section in before the cover is properly placed ends up in a cycle of re-spreading the cover until it adjusted properly. The larger the bed, the more challenging it is to get proper placement of the top cover.

As much as making the bed is a chore, everyone enjoys slipping under the smoothed covers of a made-up bed to get a good night's sleep. Sleepers snuggle under the covers or alternatively, a small child is "tucked in" by a loving adult. Unfortunately, a sleeper's unconscious movements during the night can result in covers lying in a heap on the floor or at the bottom of the bed. The disarray or lack of covers then wakes the sleeper who may, in turn, disturb others. Small children especially may cry out from being cold.

Others have attempted solutions to solve both of these problems. One simple solution is to attach the two sheets by various means, such as a zipper or stitching. Some have proposed directly attaching just the bottom of the two sheets. Others have included directly attaching the bottom or the bottom and the sides of the two sheets to a third piece of bedding, a bed skirt. When the bed linens are permanently attached, washing is made more difficult with a standard agitator washer. The bedclothes do not circulate well because they are attached and the clothes can bunch up and cause an uneven spin cycle. Additionally, the optimal washing conditions for one bed linen, such as water temperature or spin cycle, may not be the same as for the bed linen to which it is attached.

When the bottom sheet and the top cover are directly attached, there is not much room for the sleeper to get between the sheets, nor enough room for the sleeper to roll-over or move around. The sleeper becomes like a letter in an envelope, fixed in a flat position. The lack of accommodation for movement results in either an uncomfortable sleeper or the covers becoming untucked. Some sleepers prefer to sleep with their feet uncovered, but like the covers tucked in at the sides. When a bed is shared, often one sleeper's style of sleeping conflicts with the other's preferred arrangement of bedding. Sleepers with sensitive feet who suffer from peripheral neuropathy or poor circulation would find the bedding arrangement especially uncomfortable. This is a recognized problem and some have proposed an elastomeric strip at the bottom of the bed at the junction of the bottom sheet and the top cover. Others suggest an elastomeric strip around the bottom and sides of the bed attaching the bottom sheet and top cover.

While these units may be suitable for the particular purpose employed, or for general use, they would not be as suitable for the purposes of the present invention as disclosed hereafter.

SUMMARY OF THE INVENTION

It is an object of the invention to produce a bed sheet attachment system that simplifies the task of making a bed with fresh linens. Accordingly, the bed sheet attachment system requires only the ability to close simple fasteners and snaps to correctly position a top cover on a bottom sheet.

It is another object of the invention to produce a bed sheet attachment system that simplifies the task for a child of making a neat bed. Accordingly, the bed sheet attachment system is fastened and snapped after the child climbs under the top cover, and an expansion panel assembly keeps the top cover in proper position throughout sleep so that the child only has to smooth wrinkles in the top cover to make a neat bed upon arising. The expansion panel assembly is hidden under the top cover when the bed is made.

It is yet another object of the invention to produce a bed sheet attachment system that keeps the top cover properly positioned on a sleeper, especially a child, so that the child does not awake from having thrown the cover off during sleep. Accordingly, the bed sheet attachment system attaches the top cover to the bottom sheet at a pair of sides and a bottom to keep the top cover in place during sleep.

It is still yet another object of the invention to produce a bed sheet attachment system that keeps the top cover properly positioned on a sleeper when two people are sharing a bed, preventing one person from pulling the covers off of the other. Accordingly, the bed sheet attachment system attaches the top cover to the bottom sheet at the pair of sides and the bottom to keep the top cover evenly distributed over the two people.

It is a further object of the invention to produce a bed sheet attachment system that keeps a top cover properly positioned on a restless sleeper, but allows the sleeper to move in his sleep. Accordingly, the bed sheet attachment system attaches the top cover to the bottom sheet at sides and bottom but creates increased cubic capacity between the bottom sheet and top cover by an expansion panel assembly.

It is a yet further object of the invention to produce a bed sheet attachment system that allows the top cover and the bottom sheet to be washed separately. Accordingly, the bed sheet attachment system impermanently attaches the top cover and the bottom sheet by a fastener strip that allows the top cover and the bottom sheet to be detached for laundering.

It is an additional object of the invention to produce a bed sheet attachment system that allows a sleeper to adjust the top cover for individual comfort. Accordingly, the bed sheet attachment system has an expansion panel assembly, that can be adjusted to allow the top cover to be folded down from the top edge or folded up from the bottom edge by unsnapping a snap tab that otherwise prevents a fastener strip from separating the top cover from the bottom sheet.

It is a still further object of the invention to produce a bed sheet attachment system that allows two people sharing a bed to adjust the top cover independently. Accordingly, the bed sheet attachment system has a pair of expansion panel assemblies, each on a side of a bed that can be adjusted to allow the top cover on the first side of the bed to be folded down from the top edge or folded up from the bottom edge and to allow the top cover on the second side of the bed to be arranged differently.

The invention is a bed sheet attachment system with a pair of expansion panel assemblies that attaches a top cover to a bottom sheet by a plurality of panel strips connected by a plurality of fastener strips. The fastener strips are prevented from opening during sleep by a plurality of snap tabs. The plurality of panel strips provides increased cubic capacity between the top cover and bottom sheet for the sleeper to slip into and move within the bed. The plurality of snap tabs allows the panel strips to be separated at discrete lengths to accommodate the sleeper's needs and desires for the arrangement of the top cover during sleep. The bed sheet attachment system simplifies the daily making of the bed by maintaining the proper position of the top cover during sleep so that the user merely smoothes out the wrinkles on the top cover upon arising.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 3:
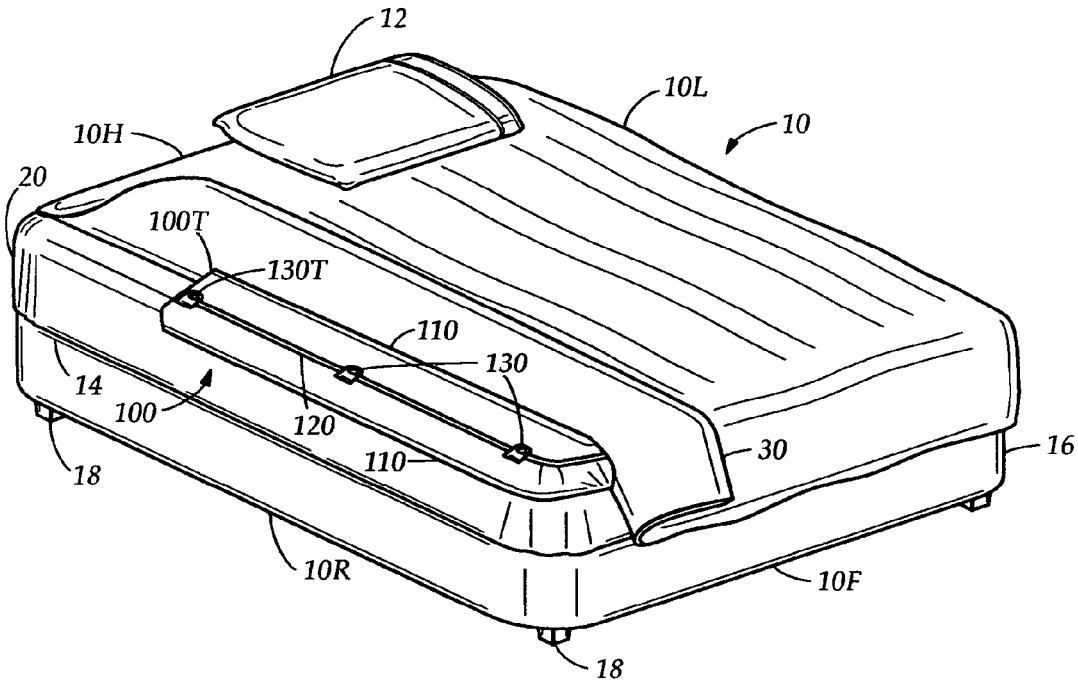
FIG. 3 is a diagrammatic perspective view of the bed with the bottom sheet, the top cover and the invention, with the top cover drawn back, showing the invention in place.

FIG. 3 illustrates a system for attaching a top cover 30 to a bottom sheet 20 on a bed 10. The top cover 30 is folded over to illustrate the invention in place on the bed 10. The system has an expansion panel assembly 100 connecting the bottom sheet 20 to the top cover 30. In the illustrated embodiment, the expansion panel assembly 100 has a pair of fabric panel strips 110 connected by a fastener strip 120. The fastener strip 120 has a length and a plurality of snap tabs 130 spanning between the pair of panel strips 110 that selectively prevents the fastener strip 120 from separating the pair of panel strips 110, but selectively allows the fastener strip 120 to open and separate the pair of panel strips 110 at discrete intervals along the length of the fastener strip. The fastener strip 120 may be, for example, but not limited to, a zipper, a hook and loop fastener, or similar devices for impermanently fastening two fabrics together.

The expansion panel assembly 100 has a pair of ends, and a first top end 100T is shown in the illustration. The expansion panel assembly 100 holds the top cover 30 in place, but the top cover 30 can be folded over and down to the top end 100T of the expansion panel assembly 100 to allow vertical movement of the top cover with respect to the bottom sheet so that a sleeper can slip between the top cover 30 and the bottom sheet 20. When connected, the top cover 30 and the bottom sheet 20 define a closed space for the sleeper to move within. The expansion panel assembly 100 enlarges the cubic capacity of the closed space between the top cover 30 and bottom sheet 20 without causing the top cover 30 to move. Even if the sleeper is extremely restless, the top cover 30 remains in place. When the sleeper awakes, the top cover 30 is in place and a simple smoothing of wrinkles in the top cover 30 produces a perfectly made bed. The system simplifies bed making so that a child can easily and quickly make the bed 10. The top cover 30 hides the expansion panel assembly 100 to maintain the neat appearance. If the sleeper desires more room to get in or out of bed, he or she simply unsnaps a snap tab 130T located at the top of the expansion panel assembly 100T and separates the fastener strip 120 to partially disconnect the pair of panel strips 110.

The bed 10 has a pair of ends, the first is a head 10H, indicated by the placement of a pillow 12, and the second is a foot 10F, opposite the head. The bed has a right side 10R, shown with the top cover folded back and a left side 10L opposite and a plurality of corners at the intersection of the sides with the head 10H and foot 10F. When referring to a particular side, the designation of sides is based on the convention of stage directions, using the orientation of the sleeper lying face up as a reference point. The bed 10, as illustrated, is a typical American style rectangular bed with a mattress 14, lying on a box spring 16, and the box spring held in place by a frame (not shown) with a plurality of legs 18. It is understood that the invention can be employed on any bed having a mattress with a head and a foot, including both rectangular and non-rectangular beds of various shapes and sizes, which may require customized bottom sheets and customized top covers.

Figure 2:
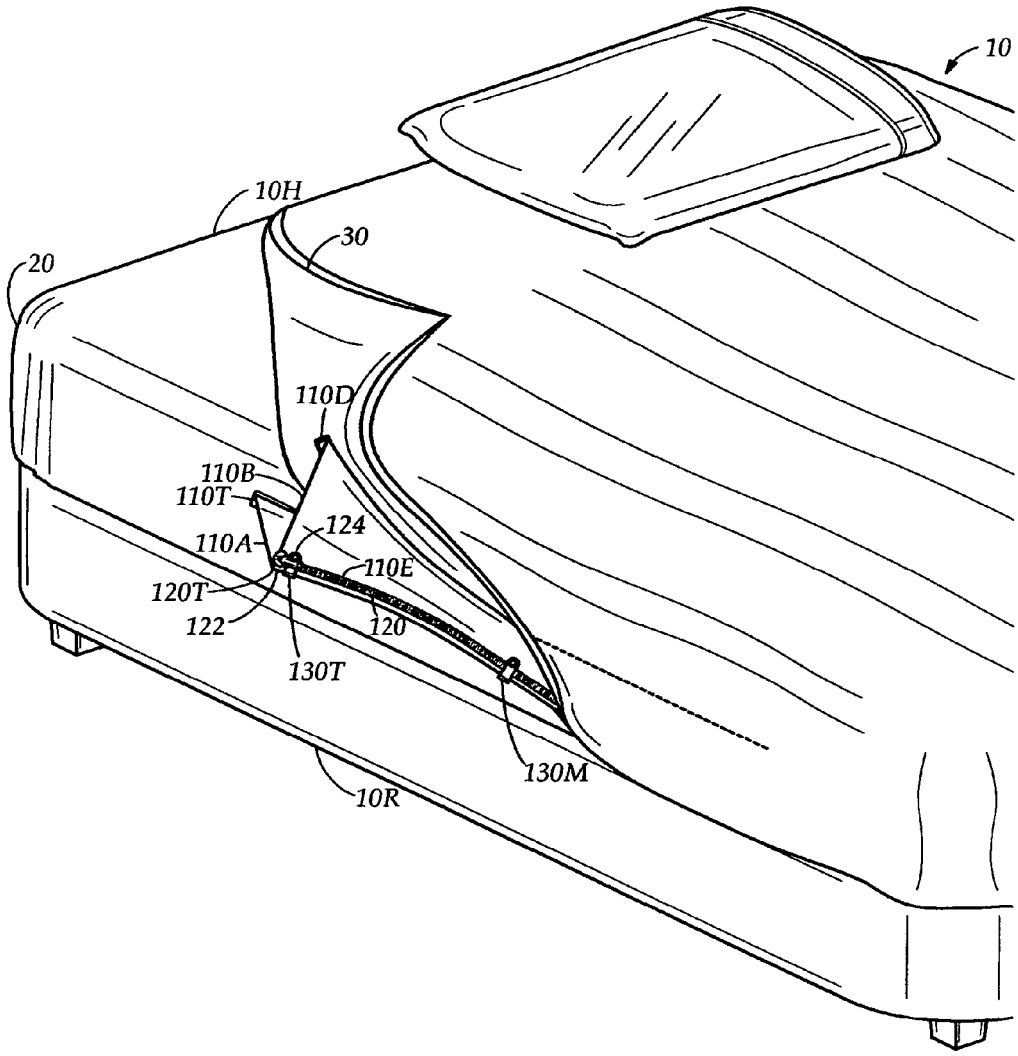
FIG. 2 is a sectional view of an upper top section of the bed, with the top cover drawn back, showing the invention in place.

FIG. 2 shows in detail the system in place as illustrated by a section of the right side 10R of the bed 10. The top cover 30 is pulled back to show the invention. The top cover 30 can be one or more layers of typical bedding generally such as, for example, but not limited to, a flat sheet, a blanket, a comforter, a duvet, a quilt, a spread or a combination of one or more styles of bedding. The system connects the top cover 30 and the bottom sheet 20, starting on the right side about one-fourth of the length of the right side 10R, from the head 10H. The pair of panel strips has a first panel strip 110A and a second panel strip 110B. Each of the panel strips has a pair of long edges, a top long edge 110D and a bottom long edge 110E. The top long edge 110D of the first panel strip 110A of the pair of panel strips 110 is attached to the bottom sheet 20. The top long side 110D of the second panel strip 110B is attached to the top cover 30. The top long edges of the panel strips 110 may be attached to the top cover 30 and bottom sheet 20 by stitching, fabric glue, hook and loop fastener or other means of attaching two fabrics. The panel strips have a pair of ends namely a top end 110T, and a bottom end 110F. The fastener strip 120, which is a zipper in the illustrated example, is shown completely closed. The fastener strip has a top end 120T, and in this example, at the top end 120T, the zipper has a top stop 122 and a slider 124. An adjacent snap tab 130T covers the top stop 122 on the fastener strip 120 and prevents the fastener strip 120 from opening immediately adjacent to the snap tab by stopping the slider 124. When the snap on the snap tab is disengaged, the fastener strip selectively can be opened as far as a second closed snap tab 130M.

Figure 1:
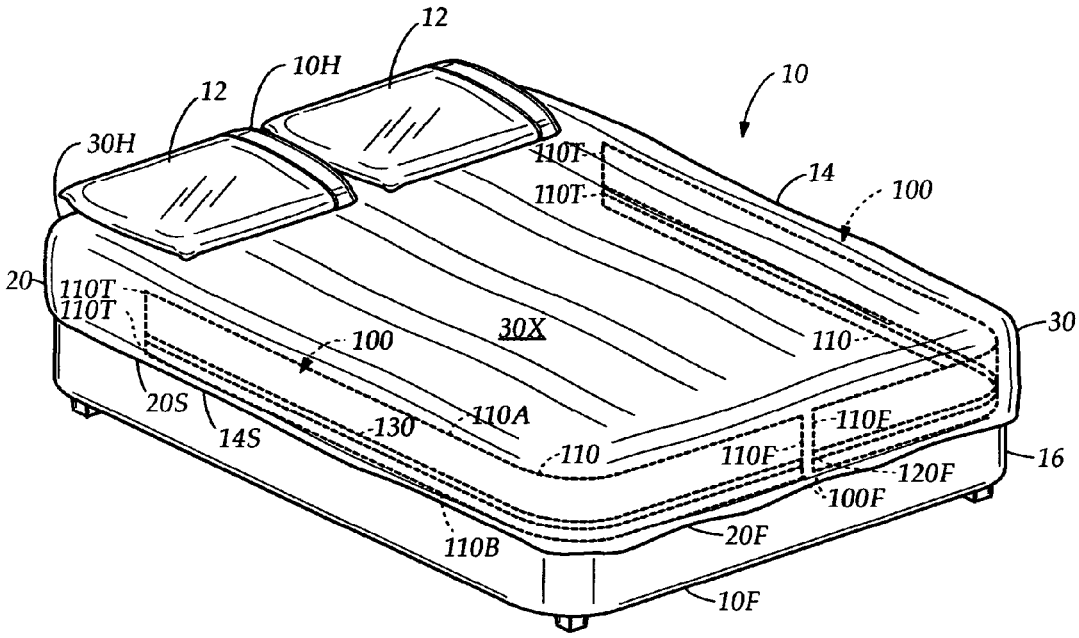
FIG. 1 is a diagrammatic perspective view of a bed with a bottom sheet, a top cover and the invention, shown in outline, in place on the bed under the top cover.

FIG. 1 shows the invention in place on the bed 10. The system has a pair of expansion panel assemblies 100, indicated by the dotted line, in place under the top cover 30. The expansion panel assemblies 100, one on each side of the bed, each having a pair of ends, the top end 100T, starting about one-fourth of the length of the side from the head 10H and the foot end 100F, ending about the middle of the foot 10F of the bed, without overlapping. Each side of the bed 10 has its own expansion panel assembly 100 for easier bed making with fresh bedding and to accommodate different sleeping styles when two sleepers share the bed 10. Starting about one-fourth of the length from the head 10H allows for easy entry by the sleeper and allows the top cover 30 to be folded over in a decorative manner. The fastener strip 120, extends longitudinally between the first panel strip 110A and the second panel strip 110E substantially fully between their top end 110T and bottom end 110F. The top cover 30 may be draped loosely or tucked in between the mattress 14 and box springs 16.

Figure 4A:
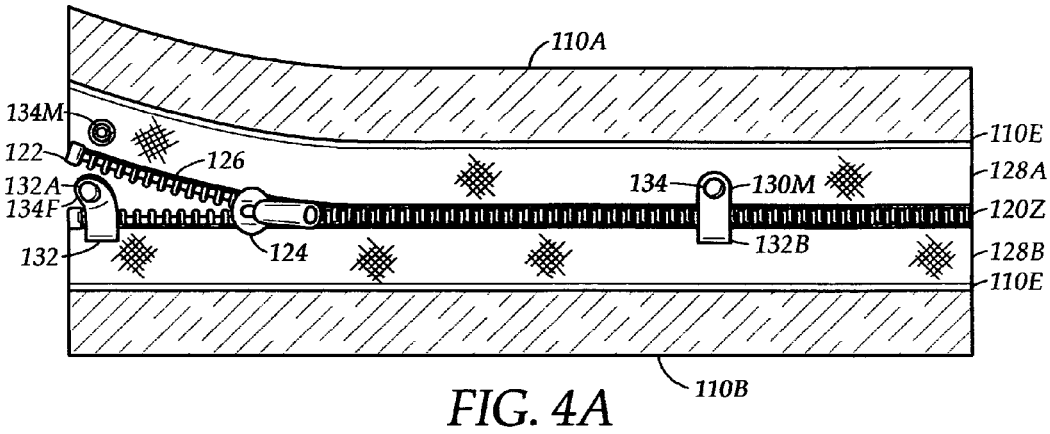
FIG. 4A is a sectional view of an embodiment of the invention, showing a connecting expansion panel assembly with a zipper.

FIG. 4A shows one embodiment of the invention, wherein the fastener strip 120 is a zipper 120Z. The zipper 120Z has a pair of interlocking teeth coils 126 on a pair of tapes 128, a first tape 128A and a second tape 128B, a teeth coil 126 each on a tape 128. The plurality of snap tabs 130 each has a tab 132 with a pair of ends, a first end 132A and a second end 132B, and a snap 134 with a pair of interlocking snap discs, a first snap disc 134M and a second snap disc 134F. The first snap disc 134M is placed on the tape 128A attached to the bottom long edge 110E of the first panel strip 110A, adjacent to the top stop 122 of the zipper. The second snap disc 134F is placed on the first end 132A of the tab 132. The pair of snap discs 134 standardly are mated, having a female snap disc and a male snap disc and it is inconsequential which snap disc is placed on the tape 128 and which on the tab 132. The second end 132B of the tab is placed adjacent to the top stop 122 of the zipper on the tape 128B attached to the bottom long edge 110E of the second panel strip 110B. As illustrated, the snap tab 132 at the end of the zipper is unsnapped and interlocking teeth coils 126 are separated down to the slider 124. The zipper can be separated by moving the slider 124 along the length of the zipper until the slider encounters a snapped snap tab 130M. In the illustration, a second snap tab 130M is snapped to stop the slider from moving down the length of the zipper. The second snap tab 130M and each subsequent snap tabs are similarly placed along the length of the fastener strip 120Z, with the snap disc 132M on the tape 128A attached to the bottom long edge 110E of the first panel strip 110A, and the mated snap disc 132F on the first end 132A of the tab 132, and the second end 132B of the tab 132 on the tape 128B attached to the bottom long edge 110E of the second panel strip 110B. If the second snap tab 130M is unsnapped, the zipper 120Z can be separated until the slider 124 encounters a snapped snap tab 130.

Figure 5A:
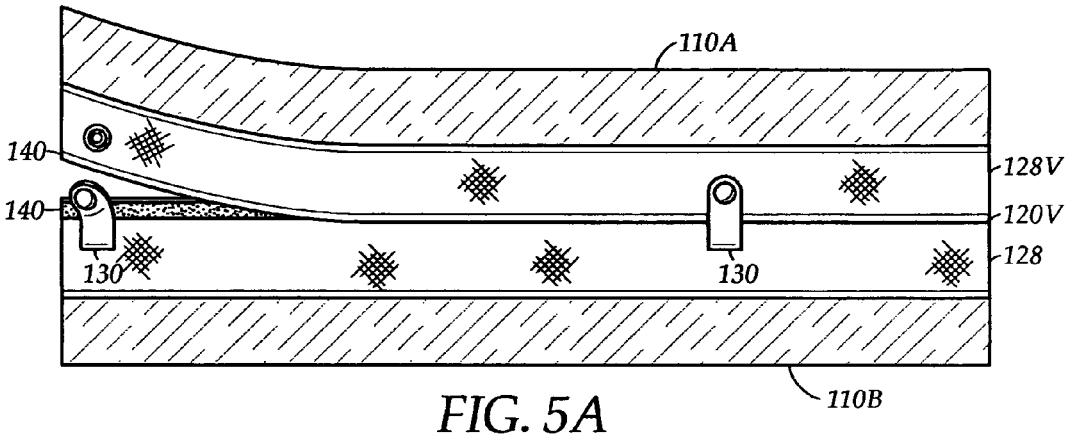
FIG. 5A is a sectional view of an embodiment of the invention, showing a connecting expansion panel assembly with a hook and loop fastener.

FIG. 5A shows an additional embodiment of the invention using a hook and loop fastener 120V as the fastener strip 120. The hook and loop fastener has a pair of tapes 128V and a "hook" side 140 on the tape 128V, which is covered with tiny hooks, and a "loop" side 140 on the tape 128V, which is covered with even smaller and "hairier" loops. When the two sides 140 are pressed together, the hooks catch in the loops and hold the tapes 128V together. In this embodiment, it is inconsequential whether the hook side 140 is attached to the first panel strip 110A or the second panel strip 110B as long as the loop side 140 is attached to the remaining panel strip. The fastener strip 120V has the plurality of snap tabs 130 that prevent the fastener strip 120V from separating as described hereinabove. The snap tabs 130 are positioned on the pair of tapes 128V in the same manner as the snap tabs are positioned on the tapes of the zipper disclosed hereinabove. The snap tabs 130 keep the hook side 140 and the loop side 140 in alignment along the length of the fastener strip 120Z and prevent the separation of the two panel strips 110.

Figure 4B:
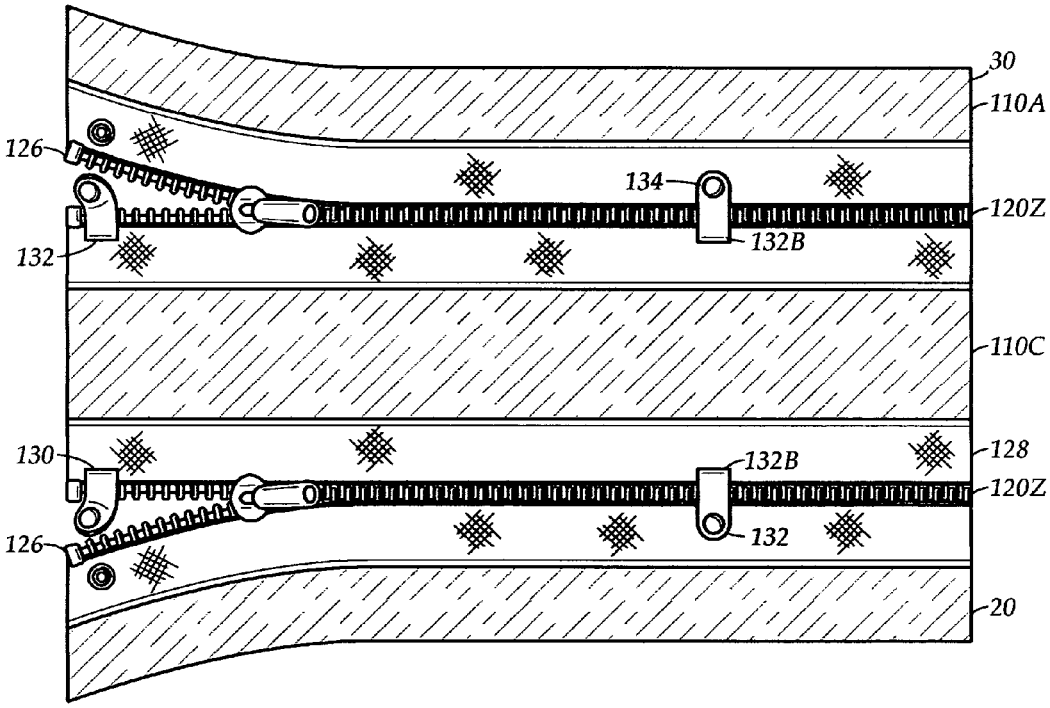
FIG. 4B a sectional view of an embodiment of the invention, showing the connecting expansion panel assembly with a pair of zippers.

FIG. 4B shows another embodiment of the invention using a pair of fastener strips, which are zippers 120Z in this example. Each of the pair of zippers 120Z has a plurality of snap tabs 132. The pair of zippers 120Z with the plurality of snap tabs 132 each functions as described in the discussion of the single zipper fastener strip hereinabove. A single zipper teeth coil 126 is directly attached to the top cover 30 and another single zipper teeth coil 126 is attached to the bottom sheet 20. The pair of zipper teeth coil provides a means to attach a removable panel strip 110C to the expansion panel assembly. The second end of the tabs 132B are located on the pair of zipper tapes 128 attached to the removable panel strip 110C. The first end 132A of the snap tabs have the snap 134 as described hereinabove. Additionally, although not illustrated, the system has three removable expansion panel assemblies, one on each side of the bed and one for the foot of the bed. The panel strip 110C is completely removable by the user on either side or the foot if so desired. The removable panel strip 110C with the attached zipper tapes 128 is symmetrical around a horizontal center axis. The symmetry allows the removable panel strip 110C to be attached to either side of the bed. This embodiment allows the user to remove the expansion panel from any side the user desires. This gives the user the option to choose which side or sides of the bed have an expansion panel, and which ones do not.

In yet another embodiment, which is not illustrated, the additional panel strip 110A is attached to the panel strip attached to top cover 30 and the panel strip attached to the bottom sheet 20. The expansion panel assembly with the additional panel strip provides additional cubic capacity for the sleeper within the closed space between the bottom sheet and the top cover.

Figure 5B:
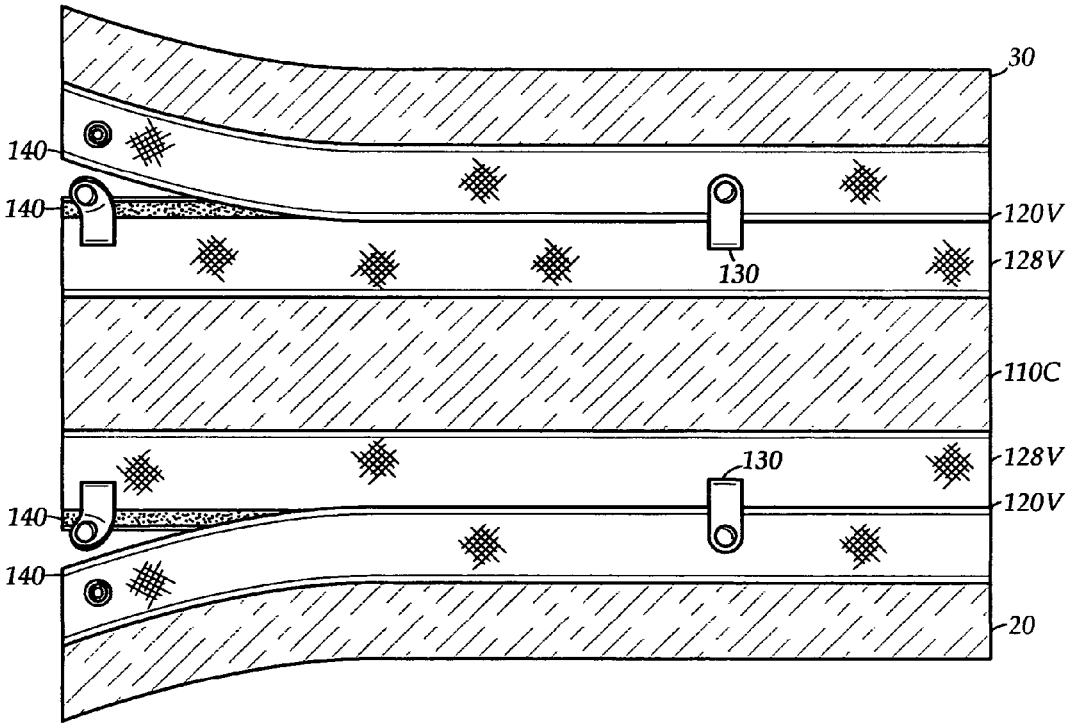
FIG. 5B a sectional view of an embodiment of the invention, showing the connecting expansion panel assembly with a pair of hook and loop fasteners.

FIG. 5B shows another embodiment of the invention using a pair of fastener strips that are hook and loop fasteners 120V. Each of the pair of hook and loop fasteners 120V has a plurality of snap tabs 130. The pair of hook and loop fasteners 120V with the plurality of snap tabs 130 each functions as described in the discussion of the single hook and loop fastener strip hereinabove. The second end of the tabs 132B are located on the pair of hook and loop tapes 128 attached to the additional panel strip 110C. In one embodiment, the hook and loop tape 128V is directly attached to the top cover 30 and hook and loop tape 128V is attached to the bottom sheet 20. The additional panel strip 110C with the attached hook and loop tapes 128 is symmetrical around a horizontal center axis, that is, both hook and loop tapes are either "hook" or "loop." The top cover 30 and bottom sheet 20 have duplicate types of hook and loop tape 140 attached. The symmetry allows the additional panel strip 110C to be attached to either side of the bed.

In yet another embodiment, which is not illustrated, the pair of hook and loop fasteners provides the means to attach the additional panel strip 110C to the expansion panel assembly with the pair of panel strips attached to the top cover and bottom sheet to provide the sleeper with additional cubic capacity to move within the closed space between the top cover and the bottom sheet. The additional panel strip is completely removable as described hereinabove.

Figure 6A:
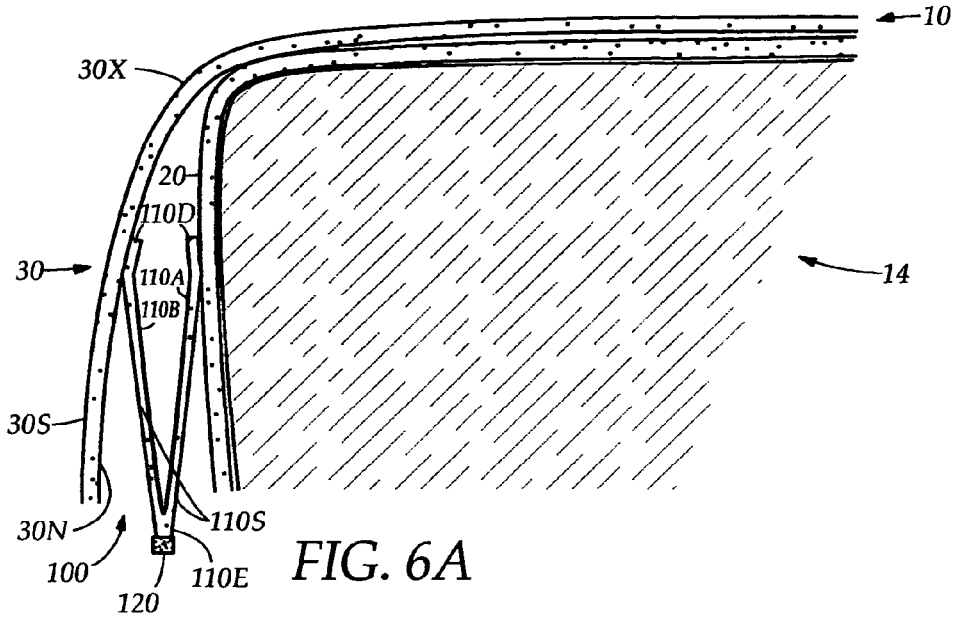
FIG. 6A is a cross-sectional view of the invention, showing the bottom sheet connected to the top cover, with the connecting expansion panel assembly in a relaxed position.
Figure 6B:
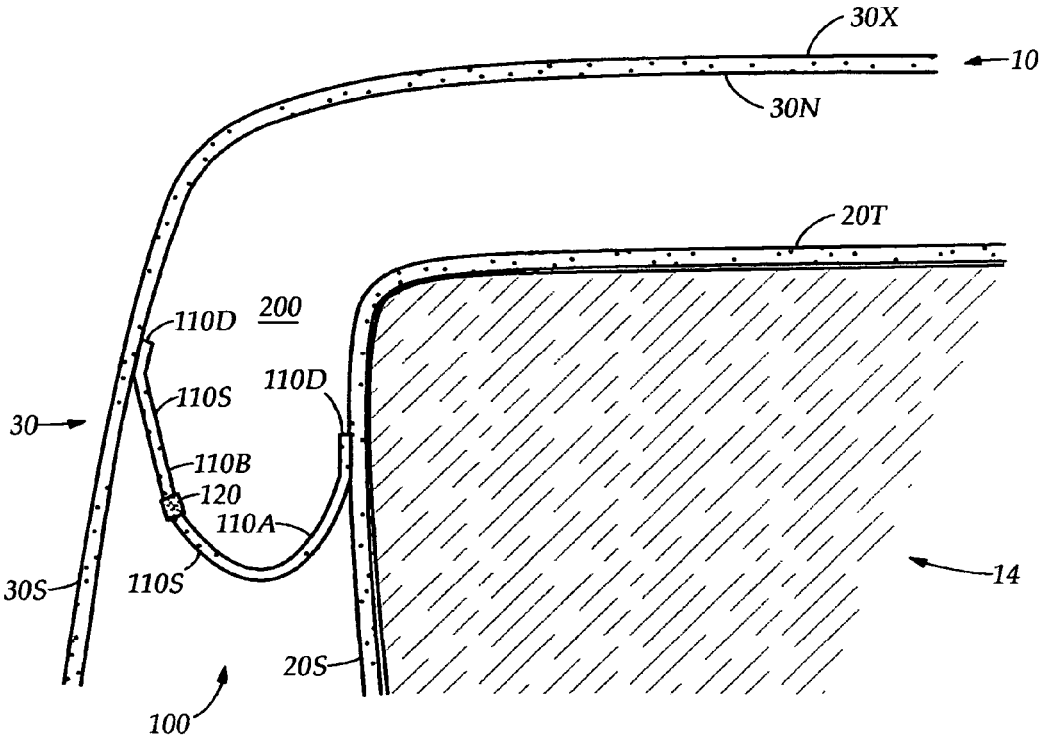
FIG. 6B is a cross-sectional view of the invention, showing the bottom sheet connected to the top cover, with the connecting expansion panel assembly in an expanded position.

FIG. 6A and FIG. 6B show the invention in a cross-sectional view, showing the expansion panel assembly 100 connecting the bottom sheet 20 to the top cover 30 with the bottom sheet 20 covering the mattress 14. The bottom sheet 20 has a top surface, a pair of sides 20S, a head, a foot and a margin at the bottom of the pair of sides, the foot, and the head that tucks under the mattress 14. The top cover 30 has a top edge, a bottom edge, and a pair of sides edges 30S, an outer surface 30× and an inner surface 30N. The panel strips 110 have a pair of short sides 1105, shown in cross section, the pair of long sides, having the top long edge 110D and the second bottom long edge 110E attached to the fastener strip 120. The first top long edge 110D of the first panel strip 110A is attached to a side of the bottom sheet 20. The first top long edge 110D of the second panel strip 110B is attached to the inner surface 30N of the top cover 30.

FIG. 6A shows the expansion panel assembly 100 in the relaxed position, with the bed 10 made up for the day. The top cover 30 smoothly lies adjacent to the bottom sheet 20 with the pair of panel strips 110 flat against the bottom sheet 20. The illustration shows space between the expansion panel assembly for the sake of clarity. The top cover 30 is aligned on the mattress and in the proper position, held there by the expansion panel assembly 100 in the relaxed position. Although this cross-sectional view does not show the complete side edge 30S of the top cover, the side edge 30S of the top cover 30 extends below the expansion panel assembly 100 and hides the expansion panel assembly, regardless if the side edge 30S of the top cover 30 is draped or tucked in below the mattress 14.

FIG. 6B shows the expansion panel assembly 100 in the expanded position, which occurs when a sleeper is between the top cover 30 and bottom sheet 20. The invention allows the top cover 30 to move out and away from the bottom sheet 20, providing additional cubic capacity 200 for the sleeper to move within. Direct attachment of the top cover 30 to the bottom sheet 20 without the expansion panel assembly 100 of the invention provides no space for the sleeper to move within the bedding. With the expansion panel assembly 100 in place, the top cover 30 remains aligned on the mattress 14 and in the proper position.

Figure 7A:
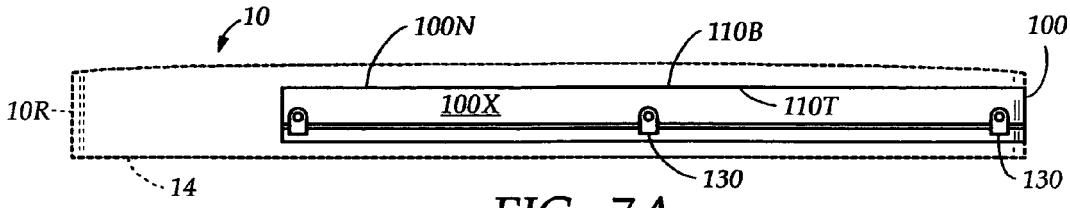
FIG. 7A is a right side elevational view of the bed, in outline, with the invention in place.
Figure 7B:
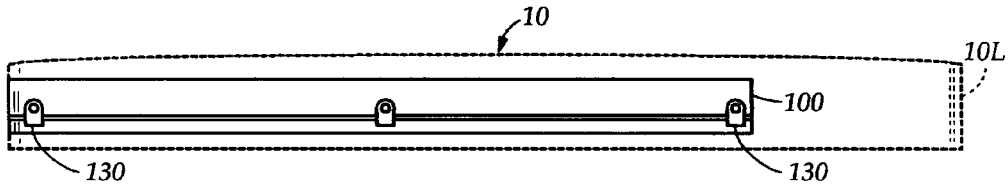
FIG. 7B is a left side elevational view of the bed, in outline, similar to FIG. 7A, with the invention in place.
Figure 7C:
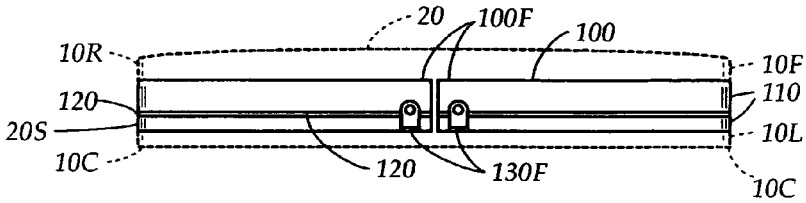
FIG. 7C is a bottom elevational view of the bed, in outline, with the invention in place.

FIG. 7A shows the expansion panel assembly 100 in place attached to the bottom sheet on the right side of the bed 10R. The bottom sheet 20 and mattress 14 are shown in outline without the top cover for clarity. The expansion panel assembly 100 has an inside surface 100N and an outside surface 100×. The inside surface 100N faces the increased cubic capacity created between the bottom sheet 20 and top cover 30. The outside surface 100X is on the reverse of the inside surface of the expansion panel assembly 100. The second panel strip 110B is shown at the top of the expansion panel assembly 100. The first top long edge 110D of the second panel strip 110B is attached to the inner surface of the top cover, which is not shown in the drawing. The plurality of snap tabs 130 and the fastener strip 120 are on the outside surface 100X of the expansion panel assembly 100 away from the sleeper. The first top long edge 110D of the first panel strip 100A is attached to bottom sheet 20, which is not shown in this illustration. FIG. 7B, similar to FIG. 7A, illustrates the left side 10L of the bed 10 with the expansion panel assembly 100 placed as described hereinabove with reference to FIG. 7A. FIG. 7C shows the foot 10F of the bed 10. The second end 100F of each of the expansion panel assemblies 100 are centered on the bottom sheet 20 at the foot 10F of the bed 10 without overlapping. The first expansion panel assembly 100 extends to the left around the corner 10C and along the right side 10R of the bed; the second expansion panel assembly 100 extends to the right around to the left side 10L of the bed. A final snap tab 130F is on the second end 100F of each of the expansion panel assemblies. In one embodiment, the fastener strip 120 is a two slider zipper which allows the second end of the fastener strip to separate the panel strips, by unsnapping the final snap tab 130F, but still allows the expansion panel assembly 100 to remain in place on the sides. Similarly, when the fastener strip 120 is the hook and loop fastener, unsnapping the final snap tab 130F allows the panel strips 110 to be separated. Allowing the foot 10F of the bed 10 to be opened up in this manner accommodates the sleeper who prefers to sleep with his or her feet uncovered, but allows the top cover to remain in proper alignment with invention in place.

Referring now to FIG. 1, when the user desires to initially make up the bed 10 with fresh bedding, the user starts at the foot 10F of the bed 10. The user place the bottom sheet 20 on the mattress 14 so that each of the attached panel strips 110 have the bottom end 110F centered at the foot of the mattress. The mattress has a center longitudinal axis. Each panel strip 110 extends out from the center in an opposite direction along the sides of the bottom sheet 20. The top cover 30 is placed on top of the bottom sheet 20, with the inside surface facing the bottom sheet 20 and centered on the center longitudinal axis of the mattress 14 with the bottom edge 30B of the top cover 30 sufficiently draped over the foot 14F of the mattress 14. On one side of mattress 14S, the panel strip 110 on the bottom sheet 20 is attached to the panel strip 110 on the top cover 30 by the fastener strip 120. This is repeated on the other side of the mattress. In one example, where the fastener strip 120 is the zipper, the slider is pulled upwards, starting at the bottom end 120F of the fastener strip 120. In another example, where the zipper 120 has a pair of sliders, a first slider and a second slider, the first slider is pulled upward, the second slider remaining at the bottom end 120F of the fastener strip 120. If the user preferably desires that top cover 30 be folded back to allow the sleeper's feet to be uncovered, the second slider is pulled upward to separate the panel strips 110. In another embodiment, where the fastener strip 120 is the hook and loop fastener, the user presses together the hook strip and the loop strip, starting at either the top end 100T or the second end 100F of the expansion panel assembly 100. Once the first panel strip 110 and the second panel strip 110 are attached by the fastener strip 120, the snaps on the snap tabs are snapped together. Wrinkles on the outer surface 30X of the top cover 30 are smoothed away by the user. Other bedding may be added by placing over the outer surface of the top cover. The top edge 30H of the top cover 30 may be folded down and pillows 12 added at the head 10H of the bed 10. The sections of the side edges 20S adjacent to the bottom edge and the bottom edge 20F of the top cover 20 may be folded and tucked to create "hospital corners" between the mattress 14 and box spring 16 for a neater appearance. The expansion panel assemblies 100 remains hidden by the top cover 30 with or without the top cover 30 being tucked between the mattress and box springs.

In one embodiment, as illustrated by FIG. 4B and FIG. 5B, the expansion panel assembly 100 has the pair of fastener strips 128 and an additional panel strip 110C. To make the bed with fresh linens with the expansion panel assembly having two fastener strips, the user places the bottom sheet and the top cover on the mattress as described hereinabove. On one side of the mattress, the top cover 30 is attached to the removable panel strip 110C by the first fastener strip 120. Then the removable panel strip 110C is attached to the bottom sheet 20 by the second fastener strip. This is repeated on the other side of the mattress. The snaps 134 on the snap tabs 130 are snapped together. The user continues with smoothing the wrinkles of the top cover, adding any desired bedding, fluffing and positioning the pillows or creating hospital corners.

Referring to FIG. 2, to sleep in the bed 10 with the bed sheet attachment system, the sleeper picks up the top cover 30 along with an additional bedding on top of the top cover, folds it back to the top of the expansion panel assembly 100 and slips in between the top cover 30 and bottom sheet 20. If the sleeper needs more room to slip into the bed 10, he or she unsnaps the snap tab 130T at the top of fastener strip 120T, and separates the panel strips 110A, 110B as far as necessary or until he or she encounters a snapped snap tab 130M. After climbing into bed 10, the sleeper refastens the fastener strip 120 and snaps the snap tab 130T. To arise, the steps are reversed.

The sleeper cannot throw the covers off or create a disorganized jumble, because the top cover 30 is firmly anchored to the sides and foot of the bottom sheet 20. However, the sleeper can easily move while sleeping within the increased cubic capacity created by the expansion panel assembly.

Referring to FIG. 7C, if the sleeper desires to sleep with his feet uncovered, the last snap 130F is unsnapped, panel strips 110 are separated by unfastening the fastening strip 120, and the bottom edge of the top cover is folded back. The sleeper cannot throw the covers off or create a disorganized jumble, because the top cover is still firmly anchored to the side 20S of the bottom sheet 20.

Referring again to FIG. 3, to make up the bed 10 upon arising on a daily basis, if the sleeper has not unsnapped the snap tabs 130 or separated the panel strips 110 by unfastening the fastening strip 120, the user merely smoothes out the wrinkles on the top cover 30, because the top cover 30 is in the correct position on the bed 10. The user may fluff the pillow or pillows 12 and place them at the head of the bed 10H as desired. If the sleeper has unsnapped the snap tabs 130 either at the side 10R, 10L or foot 10F of the bed and unfastened the fastening strip 120, the user merely refastens the fastening strip 120, reconnecting the panel strips 110 and then snapping the snap tabs 130 together. The top cover 30 is in the proper position and the user merely smoothes out the wrinkles on the top cover 30.

In conclusion, herein is presented a bed sheet attachment system for removably attaching a bottom sheet to a top cover with a connecting expansion panel assembly and a method for making and using a bed with the expansion panel assembly in place. The invention is illustrated by example in the drawing figures, and throughout the written description. It should be understood that numerous variations are possible, while adhering to the inventive concept. Such variations are contemplated as being a part of the present invention.

What is claimed is:

1. A bed sheet attachment system for use on a bed with a bottom sheet and a top cover, the bed having a head, a foot and a pair of sides and a plurality of corners where each side intersects the head and the foot, comprising:

a plurality of expansion panel assemblies, each expansion panel assembly having a pair of panel strips, namely a first panel strip attached to the bottom sheet and a second panel strip attached to the top cover, said panel strips having a top end and a bottom end, each expansion panel assembly also having a fastener strip extending longitudinally between the first panel strip and second panel strip substantially fully between their top and bottom ends, for selectively fastening the first panel strip and the second panel strip and thereby securing the top cover and bottom sheet, the fastener strip also selectively separating for allowing the top cover to be drawn back, the fastener strip having a pair of ends, the attachment of the first panel strip and second panel strip to the bottom sheet and top sheet respectively allow vertical movement of the top sheet while the top sheet and bottom sheet remain attached; and a plurality of snap tabs attached adjacent to the fastener strip, including at least one snap tab at each end of the fastener strip, each snap tab selectively spanning between the first panel strip and the second panel strip for selectively preventing the fastener strip from separating immediately adjacent to said snap tab, the snap tabs also selectively detaching from one of the first panel strip and second panel strip for allowing the fastener strip to separate immediately adjacent thereto.

2. The bed sheet attachment system as described in claim 1, wherein the pair of expansion panel assemblies are attached to the bottom sheet and the top cover at the foot and the sides of the bed.

3. The bed sheet attachment system as described in claim 2, wherein the pair of expansion panel assemblies attaching the bottom sheet and the top cover, each having a top end and a second end, the top end is positioned on the side of the bed about one-fourth of the distance between the head and the foot and second end is positioned on the foot of the bed.

4. The bed sheet attachment system as described in claim 3, wherein the pair of expansion panel assemblies can be fastened and unfastened at the top end and the bottom end.

5. The bed sheet attachment system as described in claim 4, wherein the plurality of expansion panel assemblies are positioned, with a pair of expansion panel assembly each on a side of the bed, the top end is positioned on the side of the bed about one-fourth of the distance between the head and the bottom end is positioned at the corner intersecting the side of bed and foot of the bed and a third expansion panel assembly positioned on the foot of the bed from one corner intersecting one side of the bed and the foot of the bed to the other corner of the other side intersecting the foot of the bed.

6. The bed sheet attachment system as described in claim 5, wherein each of the pair of expansion panel assemblies can be fastened and unfastened independently.

7. The bed sheet attachment system as described in claim 5, wherein the expansion panel assembly has a plurality of panel strips and a plurality of fastener strips.

8. The bed sheet attachment system as described in claim 7, wherein the plurality of fastener strips are directly attached, one to the top cover and one to the bottom sheet.

9. The bed sheet attachment system as described in claim 8, wherein the panel strip is attached to the fastener strips directly attached on the top cover and bottom sheet.

10. The bed sheet attachment system as described in claim 9, wherein the fastener strip is a zipper.

11. The bed sheet attachment system as described in claim 10, wherein the fastener strip is a hook and loop fastener.

12. A method of using a bed sheet attachment system on a bed with a bottom sheet and a top cover, the bed having a mattress, a head, a foot and a pair of sides, the bed sheet attachment system having a pair of expansion panel assemblies, an expansion panel assembly having a pair of panel strips, a first panel strip attached to the bottom sheet, a second panel strip attached to the top cover, and a fastener strip fastening the first panel strip and the second panel strip, the fastener strip having a pair of ends and a plurality of snap tabs attached to the fastener strip, at least one snap tab at each end of the fastener strip, joining the first panel strip and the second panel strip, comprising:

placing the bottom sheet on the mattress with the first panel strips of the expansion panel assemblies attached;

positioning the top cover on top of the bottom sheet with the second panel strips of the expansion panel assemblies attached;

fastening the first panel strips to the second panel strips with the fastener strip; and snapping the snaps on the snap tabs.

13. The method of using a bed sheet attachment system as described in claim 12, wherein an additional panel strip is attached by a plurality of fastener strips, having a first fastener strip attached to the top cover and a second fastener strip attached to the bottom sheet, the first fastener strip fastening the additional panel strip to the top cover and the second fastener strip fastening the additional panel strip to the bottom sheet.

14. The method of using a bed sheet attachment system as described in claim 13, wherein an additional panel strip is attached by a plurality of fastener strips, having a first fastener strip and a second fastener strip, the first fastener strip fastening the additional panel strip to the first panel strip and the second fastener strip fastening the additional panel strip to the second panel strip.

15. A method of making a bed using a bed sheet attachment system with a bottom sheet and a top cover, using a bed sheet attachment system having a pair of expansion panel assemblies, an expansion panel assembly having a pair of panel strips, a first panel strip attached to the bottom sheet, a second panel strip attached to the top cover, and a fastener strip fastening the first panel strip and the second panel strip, the fastener strip having a pair of ends and a plurality of snap tabs attached to the fastener strip, at least one snap tab at each end of the fastener strip, joining the first panel strip and the second panel strip, and a sleeper having slept in the bed and arisen with the snap tabs snapped and the fastener strip fastened, comprising smoothing the top cover.

16. A method of making a bed using a bed sheet attachment system as described in claim 15, wherein the sleeper having slept in the bed and arisen by unsnapping snap tabs and unfastening fastening strips, comprising fastening the first panel strips to the second panel strips with the fastener strip; snapping the snaps on the snap tabs; and smoothing the covers.

* * * * *